US007755906B2

(12) United States Patent
Sato

(10) Patent No.: US 7,755,906 B2
(45) Date of Patent: Jul. 13, 2010

(54) ELECTRONIC APPARATUS

(75) Inventor: Naruhiko Sato, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 770 days.

(21) Appl. No.: 11/635,056

(22) Filed: Dec. 7, 2006

(65) Prior Publication Data

US 2007/0261308 A1 Nov. 15, 2007

(30) Foreign Application Priority Data

Apr. 27, 2006 (JP) ..... 2006-123800

(51) Int. Cl.
*H05K 7/00* (2006.01)

(52) U.S. Cl. ..... 361/747; 361/683; 361/730; 361/733; 361/752

(58) Field of Classification Search ..... 361/747, 361/683, 730, 733, 752
See application file for complete search history.

(56) References Cited

U.S. PATENT DOCUMENTS

| | | | | |
|---|---|---|---|---|
| 5,522,740 | A * | 6/1996 | Plocek et al. | 439/752 |
| 6,213,793 | B1 * | 4/2001 | Norizuki et al. | 439/157 |
| 6,315,582 | B1 * | 11/2001 | Nishio et al. | 439/131 |
| 6,364,699 | B1 | 4/2002 | Hwang et al. | |
| 6,522,550 | B1 * | 2/2003 | Nishio et al. | 361/752 |
| 6,742,070 | B2 * | 5/2004 | Fuchida | 710/303 |
| 6,991,479 | B2 * | 1/2006 | Miao | 439/133 |
| 7,118,483 | B2 * | 10/2006 | Beadell et al. | 463/46 |
| 7,151,664 | B2 * | 12/2006 | Hosey | 361/684 |
| 7,285,004 | B1 * | 10/2007 | Fukuda et al. | 439/358 |
| 7,384,303 | B2 * | 6/2008 | Murakami et al. | 439/557 |
| 2001/0053626 | A1 * | 12/2001 | Wakino | 439/459 |
| 2003/0058614 | A1 | 3/2003 | Na et al. | |
| 2003/0220002 | A1 * | 11/2003 | Chen | 439/133 |
| 2004/0076048 | A1 * | 4/2004 | Kabenjian et al. | 365/200 |
| 2006/0069826 | A1 * | 3/2006 | Lei et al. | 710/72 |
| 2006/0073717 | A1 * | 4/2006 | Ng et al. | 439/131 |
| 2006/0077634 | A1 | 4/2006 | Chen et al. | |
| 2006/0203460 | A1 * | 9/2006 | Aviv | 361/788 |
| 2006/0230199 | A1 * | 10/2006 | Yu | 710/62 |
| 2007/0016965 | A1 * | 1/2007 | Dan et al. | 726/34 |

(Continued)

FOREIGN PATENT DOCUMENTS

| | | | |
|---|---|---|---|
| CN | 2454915 | Y | 10/2001 |

(Continued)

*Primary Examiner*—Tuan T Dinh
*Assistant Examiner*—Xiaoliang Chen
(74) *Attorney, Agent, or Firm*—Sughrue Mion, PLLC

(57) ABSTRACT

An electronic apparatus comprising: a unit which is mountable and removable at an electronic apparatus main body; a locking component; a mounted component which is mounted at the unit; a stopper member which is mounted at the unit and impedes removal of the mounted component from the unit; a first engaged portion which is provided at one of the unit and the stopper member; and a first engaging portion which is provided at the other of the unit and the stopper member, the first engaging portion engaging with the first engaged portion when the stopper member is mounted at the unit and impeding removal of the stopper member from the unit, being operable for releasing the engagement with the first engaged portion, and being inoperable in a state in which the unit is mounted at the electronic apparatus main body, is provided.

17 Claims, 7 Drawing Sheets

U.S. PATENT DOCUMENTS

| | | | | |
|---|---|---|---|---|
| 2007/0033320 | A1* | 2/2007 | Wu et al. | 711/100 |
| 2007/0114054 | A1* | 5/2007 | Le Mon | 174/61 |
| 2007/0141918 | A1* | 6/2007 | Ohta | 439/694 |
| 2008/0150679 | A1* | 6/2008 | Bloomfield | 340/5.7 |

FOREIGN PATENT DOCUMENTS

| | | | |
|---|---|---|---|
| CN | 1419174 | A | 5/2003 |
| CN | 2736836 | Y | 10/2005 |
| JP | 11-73242 | A | 3/1999 |

* cited by examiner

ELECTRONIC APPARATUS

BACKGROUND

1. Technical Field

The present invention relates to an electronic apparatus including a unit which is mountable/removable at an electronic apparatus main body to be removable to outside the electronic apparatus main body, or a mounted component which is mounted at a circuit board provided inside the electronic apparatus main body to be removable to outside the electronic apparatus main body.

2. Related Art

In an electronic apparatus such as a notebook computer, a printer or the like, it is possible to additionally install a function expansion device (unit) for expanding functionality, such as an external memory device, a communication device, a network controller or the like. In such an electronic apparatus, in order to prevent theft of the added function expansion device, a locking component such as a KENSINGTON LOCK (registered trademark) or the like is provided.

SUMMARY

According to an aspect of the present invention, there is provided an electronic apparatus comprising: a unit which is mountable and removable at an electronic apparatus main body; a locking component which, in a locked state, impedes removal of the unit from the electronic apparatus main body and, in an unlocked state, allows removal of the unit from the electronic apparatus main body; a mounted component which is mounted at the unit to be removable to outside the electronic apparatus main body; a stopper member which is mounted at the unit and impedes removal of the mounted component from the unit; a first engaged portion which is provided at one of the unit and the stopper member; and a first engaging portion which is provided at the other of the unit and the stopper member, the first engaging portion engaging with the first engaged portion when the stopper member is mounted at the unit and impeding removal of the stopper member from the unit, being operable for releasing the engagement with the first engaged portion, and being inoperable in a state in which the unit is mounted at the electronic apparatus main body

BRIEF DESCRIPTION OF THE DRAWINGS

Exemplary embodiments of the present invention will be described in detail based on the following figures, wherein.

DETAILED DESCRIPTION

Next, a first embodiment of the present invention will be described on the basis of the drawings.

Figure 1:
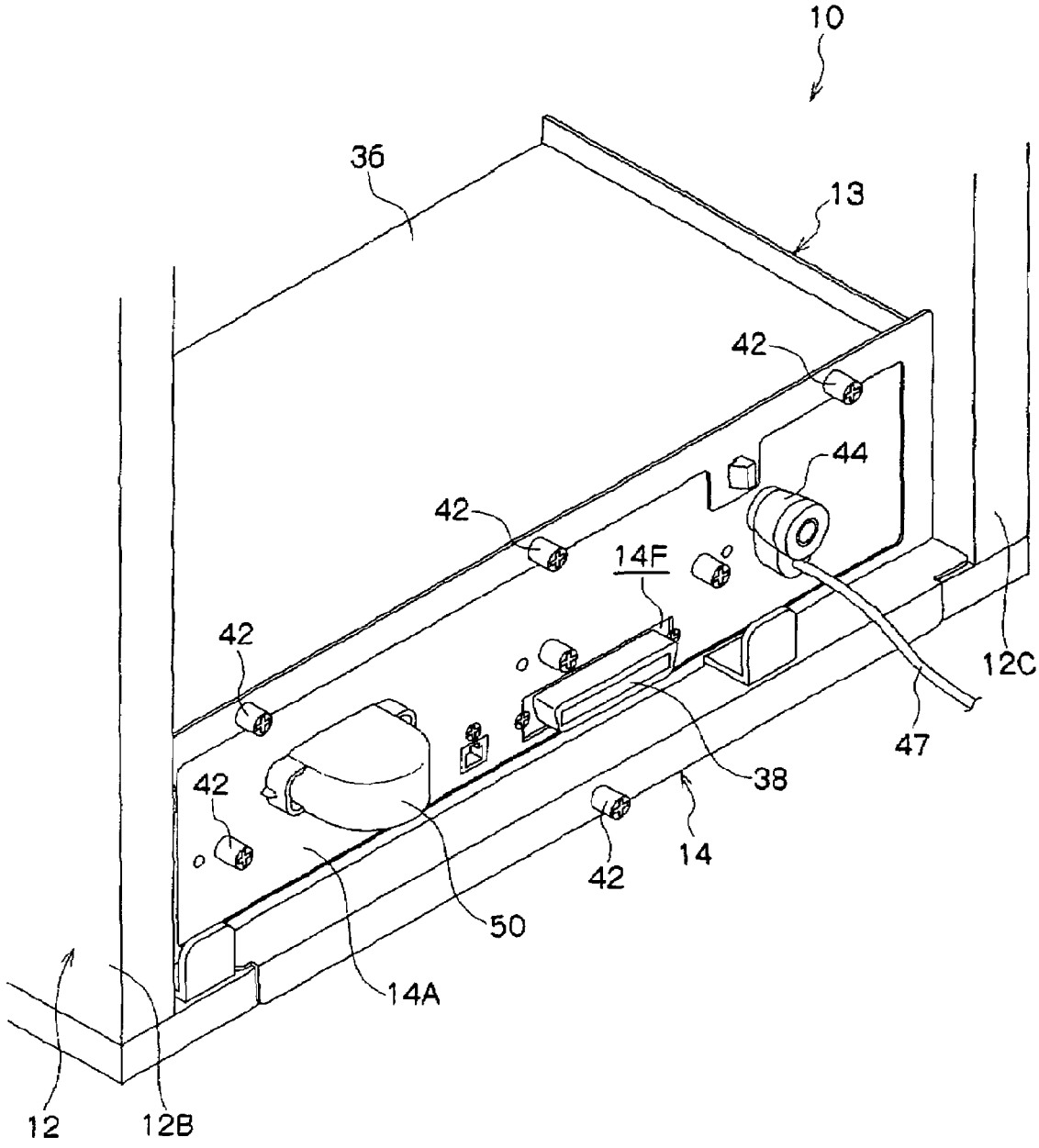
FIG. 1 is a perspective view showing principal portions of an image-forming apparatus of a first embodiment of the present invention.
Figure 2:
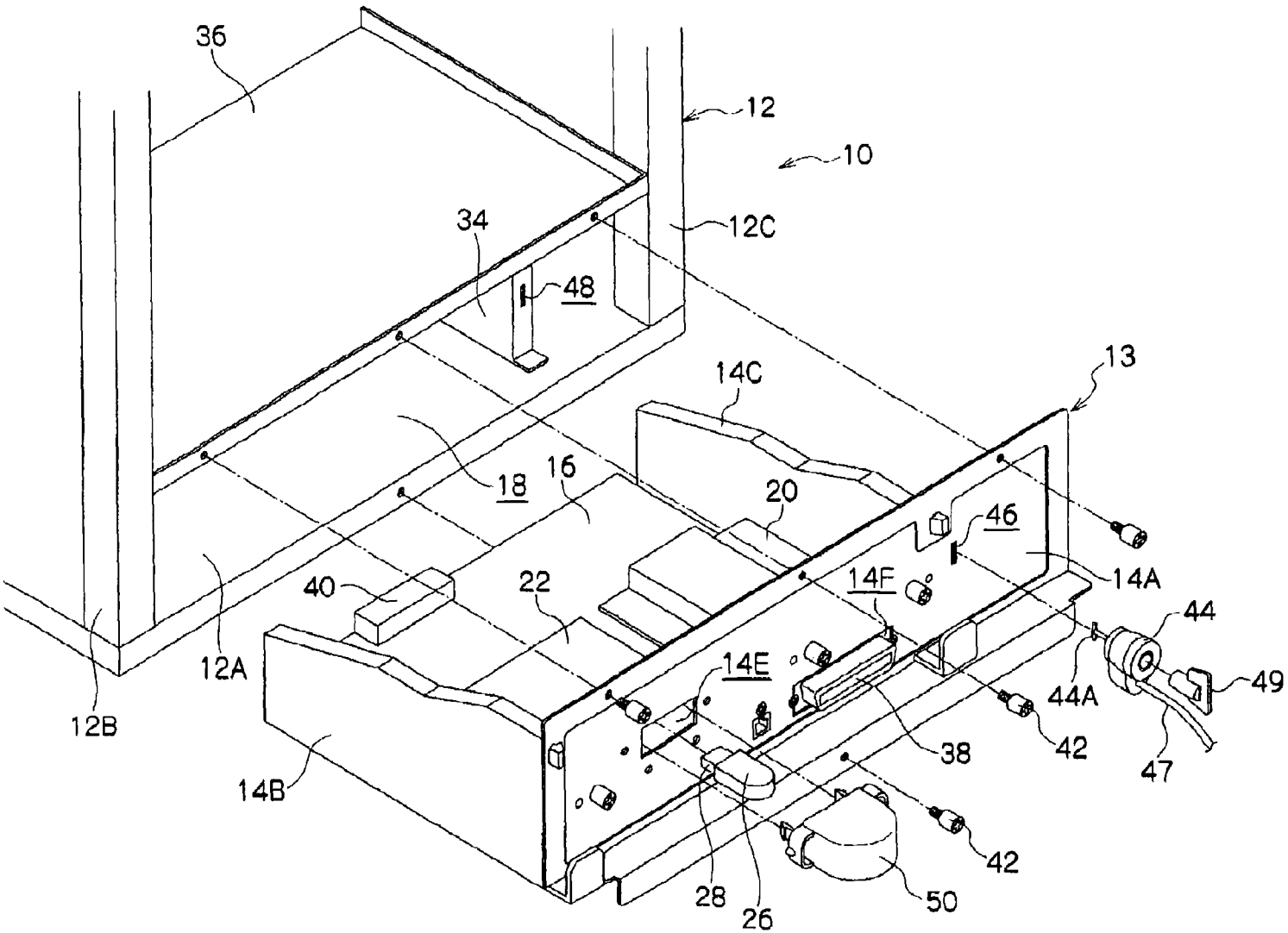
FIG. 2 is a perspective view showing principal portions of the image-forming apparatus of the first embodiment of the present invention.

As shown in FIGS. 1 and 2, at an image-forming apparatus 10 which serves as an electronic apparatus of the present invention, a mountable/removable unit 13 is disposed at an image-forming apparatus main body 12. This unit 13 includes a frame 14 at which at least a controller circuit board 16 is attached. This frame 14 is insertably/extractably (and mountably/removably) accommodated in a frame accommodation portion 18 which is provided at a lower portion of the image-forming apparatus main body 12. It is also possible, both before and after fabrication, to additionally install circuit boards for expanding functionality at the frame 14, such as an HDD circuit board 20 carrying an HDD (hard disk drive), a wireless LAN (local area network) interface circuit board 22 and the like.

Figure 3:
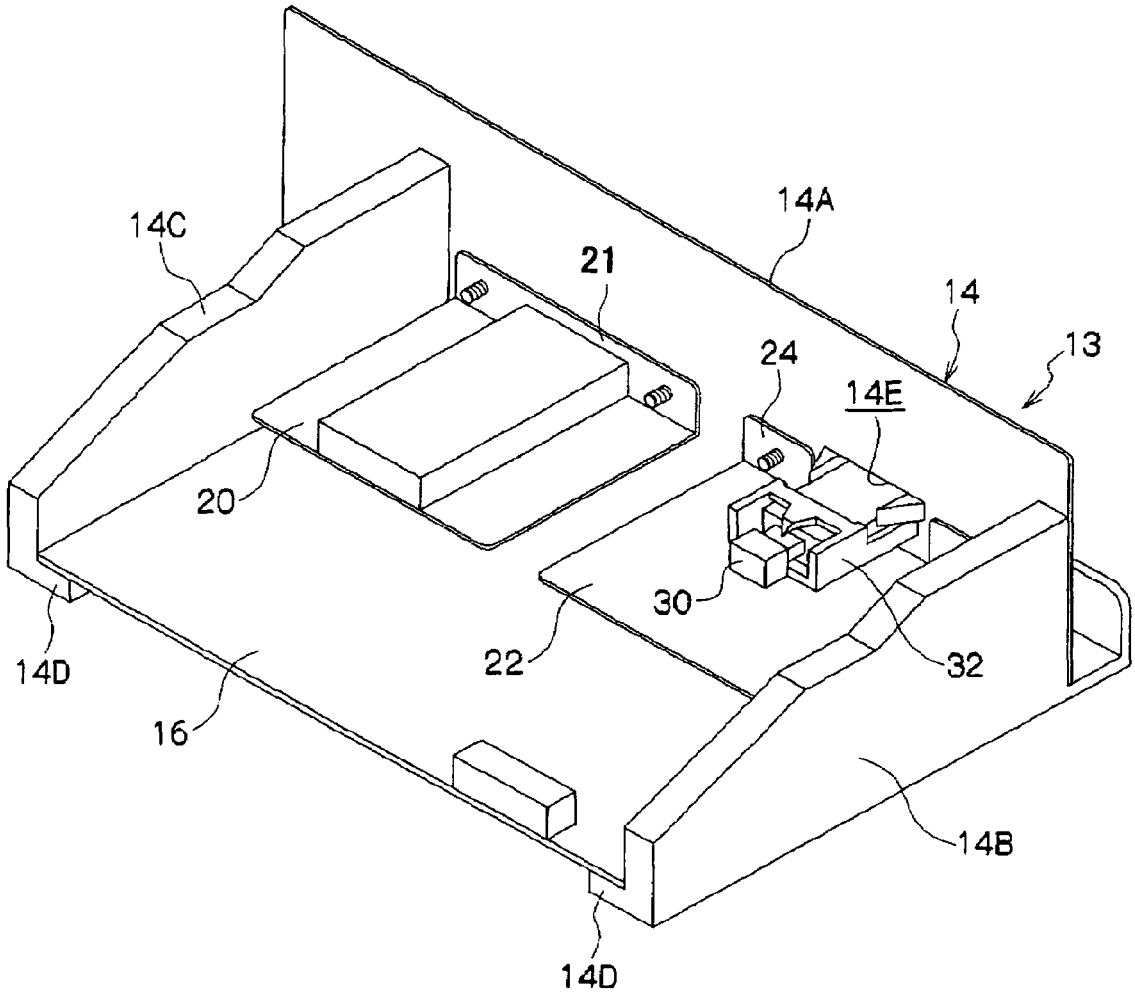
FIG. 3 is a perspective view showing a unit which is provided at the image-forming apparatus of FIGS. 1 and 2.

As shown in FIGS. 1 to 3, the frame 14 is provided standing to the outside of the image-forming apparatus main body 12 (a downstream side in an extracting direction), and is structured with an outer wall 14A, a side wall 14B and a side wall 14C. The outer wall 14A extends longitudinally in a direction perpendicular to the extracting direction (a horizontal direction of FIG. 1). The side wall 14B is joined to one longitudinal direction end portion of the outer wall 14A (a left side end portion in FIG. 1), and extends into the image-forming apparatus main body 12 (i.e., to an upstream side in the extracting direction). The side wall 14C is joined to the other longitudinal direction end of the outer wall 14A (the right side thereof in FIG. 1), and extends into the image-forming apparatus main body 12. Flange portions 14D for screw-fixing are formed at lower portions of the side wall 14B and the side wall 14C. Edge portions of the controller circuit board 16 are fixed by screws to the flange portions 14D.

A parallel connector 38 is attached to an end portion of the controller circuit board 16 at the outer wall 14A side thereof. This parallel connector 38 protrudes outside the apparatus through a rectangular through-hole 14F formed in the outer wall 14A, and enables connection of a parallel cable (not shown).

Further, at an inner side face of the outer wall 14A, the HDD circuit board 20 and the wireless LAN interface circuit board 22 are fixed with screws via respective stays 21 and 24. The HDD circuit board 20 is disposed at the upper right of the controller circuit board 16 in FIG. 2, and the wireless LAN interface circuit board 22 is disposed at the lower left of the controller circuit board 16 in FIG. 2.

A USB (Universal Serial Bus) connector 30 is mounted at the wireless LAN interface circuit board 22. A USB connector 28 of a wireless LAN transmitter/receiver 26, which serves as a mounted component, is removably connected to the USB connector 30. Of this USB connector 30, a terminal portion is arranged toward the outer wall 14A side thereof. A rectangular through-hole 14E, which serves as a first engaged portion and an engaging hole, is formed in the outer wall 14A. The through-hole 14E opposes the terminal portion of the USB connector 30 and extends longitudinally in the horizontal direction of FIG. 1.

Figure 4:
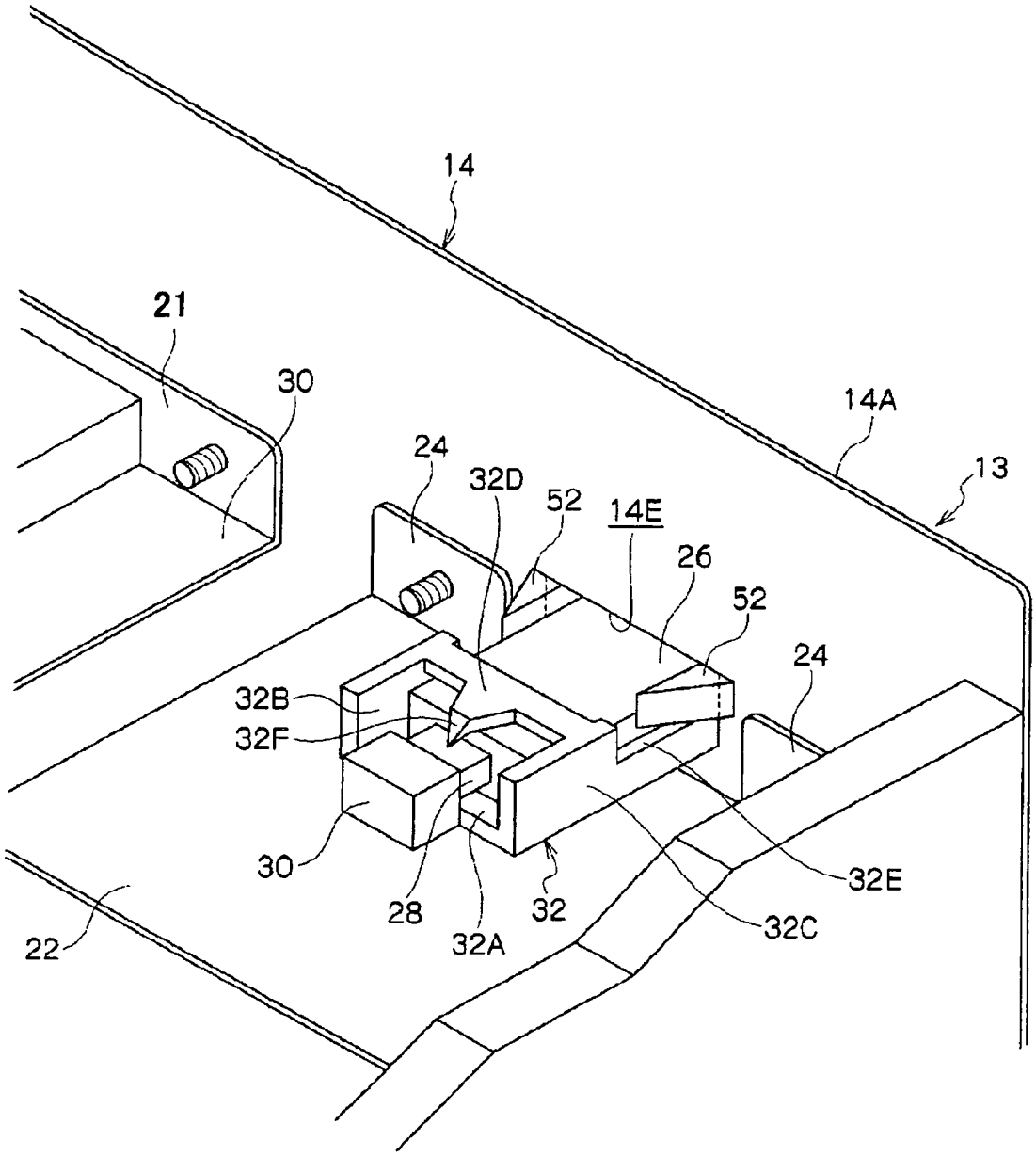
FIG. 4 is a perspective view showing an enlargement of a portion of the unit of FIG. 3.

A guide member 32, which guides mounting of the USB connector 28 of the wireless LAN transmitter/receiver 26 toward the USB connector 30, is also attached to the wireless LAN interface circuit board 22. As shown in FIG. 4, the guide member 32 is joined to the wireless LAN interface circuit board 22, and is structured by a bottom wall portion 32A, a side wall portion 32B, a side wall portion 32C and a top wall portion 32D. The bottom wall portion 32A extends from the lower side of the through-hole 14E of the outer wall 14A to the lower side of the USB connector 30. The side wall portion 32B stands from the bottom wall portion 32A and extends from the left side in FIG. 4 of the through-hole 14E to the left side of the USB connector 30. The side wall portion 32C extends substantially in parallel with the side wall portion 32B, from the right side in FIG. 4 of the through-hole 14E to the right side of the USB connector 30. The top wall portion 32D extends substantially in parallel with the bottom wall portion 32A, from an upper portion of the side wall portion 32B to an upper portion of the side wall portion 32C. Step portions 32E are formed at the outer wall 14A sides of the side wall portions 32B and 32C, to make heights thereof lower. The top wall portion 32D is joined to the USB connector 30 sides of the side wall portions 32B and 32C.

The wireless LAN transmitter/receiver 26 is a rectangular column-shaped member which is provided with the USB connector 28 at one axial direction end portion thereof. In a state in which the USB connector 28 is oriented to the inner side of the image-forming apparatus main body 12 and a long side of a sectional plane cut across an axial direction is horizontally oriented, the wireless LAN transmitter/receiver 26 is insertable/extractable at the through-hole 14E. A spacing between the side wall portion 32B and the side wall portion 32C is slightly longer than the length of the long side of the axial direction sectional plane of the wireless LAN transmitter/receiver 26. Thus, the wireless LAN transmitter/receiver 26 which is being inserted into the through-hole 14E is guided to between the bottom wall portion 32A and the top wall portion 32D by the side wall portion 32B and the side wall portion 32C.

Moreover, a spacing between the bottom wall portion 32A and the top wall portion 32D is slightly longer than the length of the short side of the axial direction sectional plane of the wireless LAN transmitter/receiver 26. Thus, the wireless LAN transmitter/receiver 26 is guided toward the USB connector 30 by the bottom wall portion 32A and the top wall portion 32D.

Figure 5:
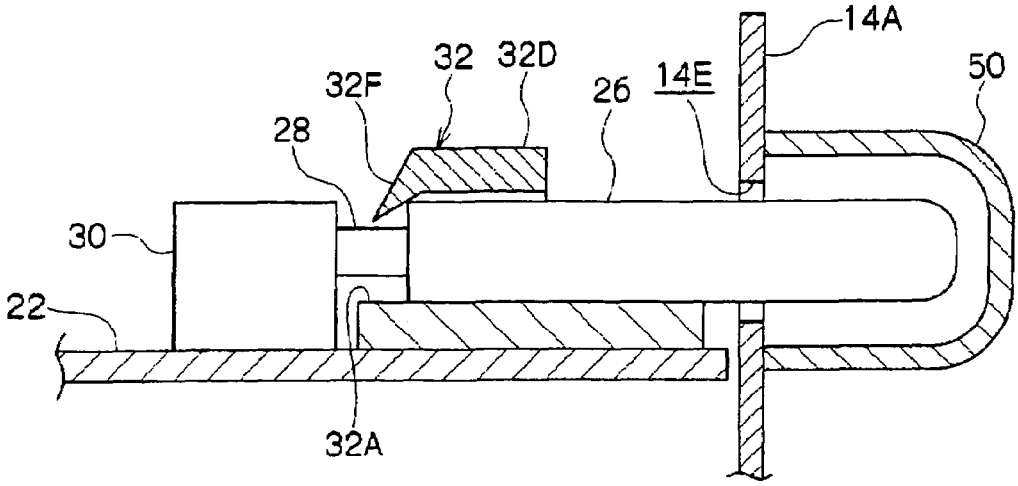
FIG. 5 is a sectional view showing an enlargement of the portion of the unit of FIG. 3.

Furthermore, as shown in FIG. 5, at an end portion of the top wall portion 32D at the USB connector 30 side thereof, a taper portion 32F is formed to serve as a guide portion, which is angled downward in the drawing. The wireless LAN transmitter/receiver 26 is guided by the taper portion 32F to a position at which the USB connector 28 and the USB connector 30 are connected. In this manner, application of the USB connector 28 of the wireless LAN transmitter/receiver 26 to the USB connector 30 is facilitated.

Here, when the USB connector 28 of the wireless LAN transmitter/receiver 26 is to be mounted to the USB connector 30, the wireless LAN transmitter/receiver 26 can be pushed into the through-hole 14E in one push, without the position of the USB connector 30 having to be found by manual searching. Therefore, after the wireless LAN transmitter/receiver 26 has been inserted into the through-hole 14E, the wireless LAN transmitter/receiver 26 need not be firmly retained, and therefore a protrusion amount of the wireless LAN transmitter/receiver 26 from the outer wall 14A can be reduced. Hence, if the image-forming apparatus 10 is to be disposed with the outer wall 14A facing a wall side, the image-forming apparatus 10 can be disposed with the outer wall 14A closer to the wall side by an amount corresponding to a reduction in the protrusion amount of the wireless LAN transmitter/receiver 26 from the outer wall 14A.

As shown in FIG. 2, the frame accommodation portion 18 is structured by a floor plate 12A of the image-forming apparatus main body 12, a side plate 12B at the left side in FIG. 2 of the image-forming apparatus main body 12, and guide plates 34 and 36 which stand from the floor plate 12A. The guide plate 34 is a rectangular plate member and extends longitudinally in a inserting/extracting direction of the frame 14, substantially in parallel with the side plates 12B and 12C, between the side plate 12B and the side plate 12C at the right side in FIG. 2 of the image-forming apparatus main body 12. The guide plate 36 is a plate member which is bent in a substantial right-angle to extend both upward in FIG. 2 from the guide plate 34 and toward a side of depth in FIG. 2.

When the frame 14 is being inserted into the frame accommodation portion 18, the frame 14 is guided relative to the left-right direction of FIG. 2 by the side plate 12B and the guide plate 34, and is guided relative to the vertical direction of FIG. 2 by the floor plate 12A and the guide plate 36. Then, when the frame 14 has been inserted to a specified position, a connector 40 mounted at an end portion at the depth side in FIG. 2 of the controller circuit board 16 connects with a connector (not shown) which is disposed at the image-forming apparatus main body 12. Further, when the frame 14 has been inserted to the specified position, the outer wall 14A can be fixed to the image-forming apparatus main body 12 by screws 42.

A KENSINGTON LOCK 44, which serves as a locking component, is connected to the image-forming apparatus main body 12 by a wire 47. Long holes 46 and 48, at which a lock anchoring portion 44A of the KENSINGTON LOCK 44 can be inserted, are formed in the outer wall 14A and the guide plate 34, respectively.

Figure 6:
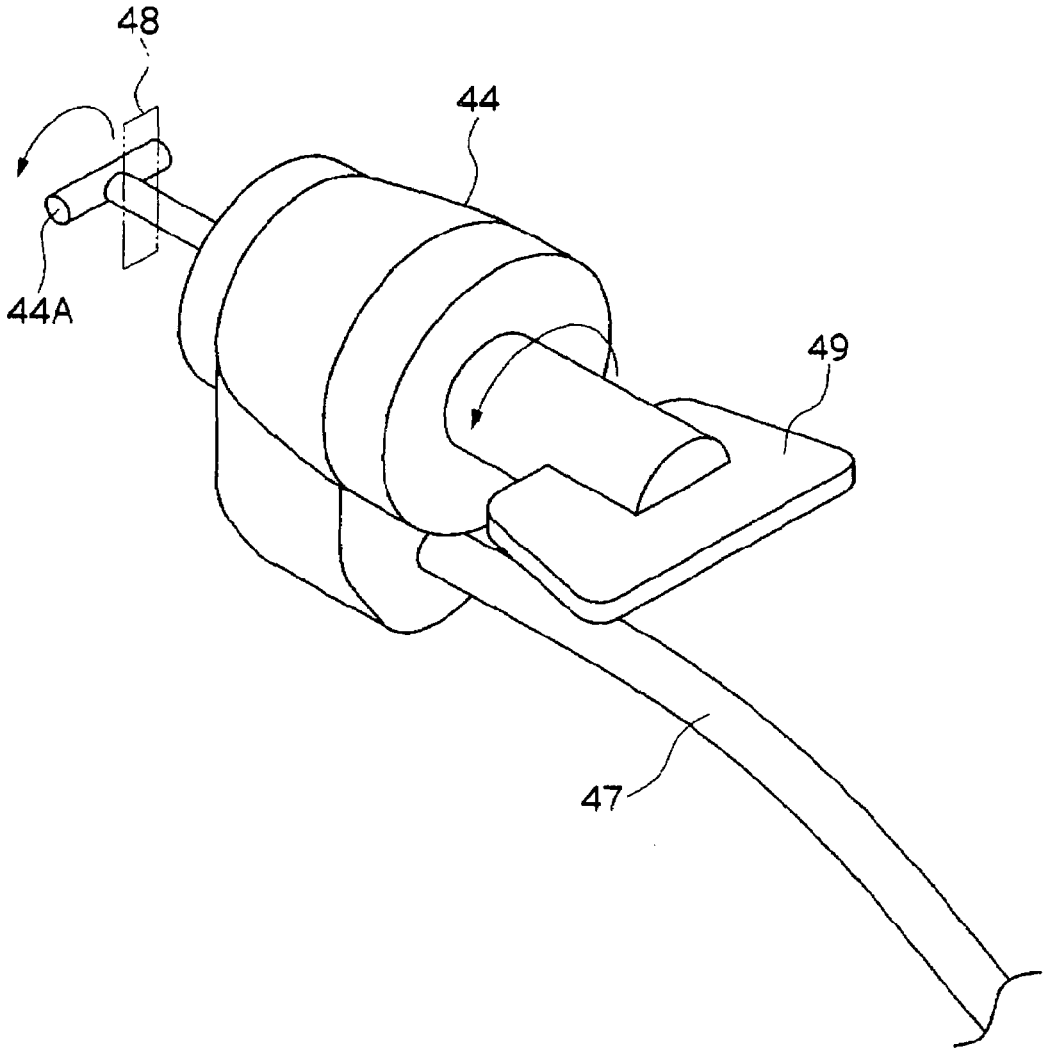
FIG. 6 is a perspective view showing a KENSINGTON LOCK which is provided at the image-forming apparatus of FIGS. 1 and 2.

As shown in FIG. 6, the 'T'-shaped lock anchoring portion 44A of the KENSINGTON LOCK 44 is inserted through the long holes 46 and 48, a key 49 is fitted into the KENSINGTON LOCK 44 and turned through 90°, and the lock anchoring portion 44A is anchored at the long hole 48. Hence, even if the screws 42 fixing the frame 14 to the image-forming apparatus main body 12 are removed, extraction (removal) of the frame 14 from the image-forming apparatus main body 12 is prevented by the KENSINGTON LOCK 44, and theft of the unit 13 can be prevented.

Figure 7:
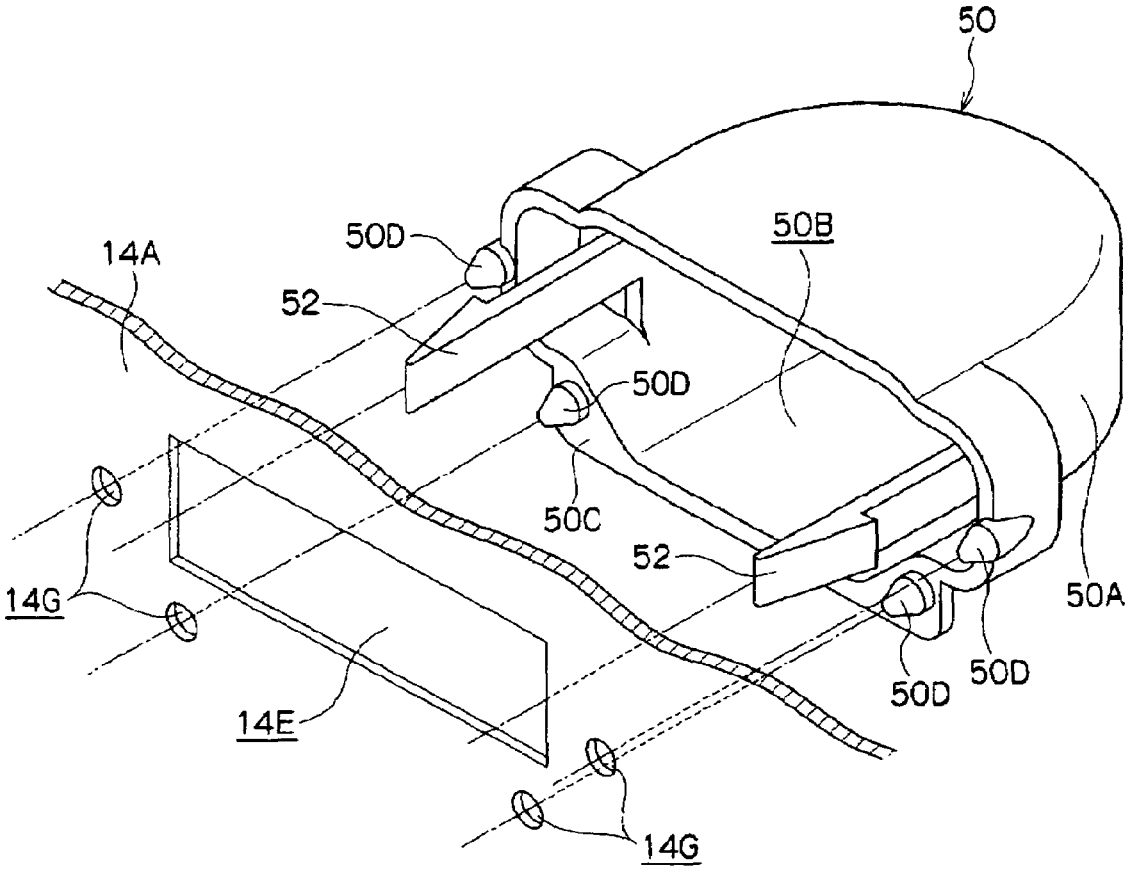
FIG. 7 is a perspective view showing an enlargement of a portion of the unit of FIG. 3.

Now, as shown in FIGS. 1 and 2, a cover 50, which serves as a stopper member and a cover body, can be mounted at the through-hole 14E. As shown in FIG. 7, the cover 50 is a tubular body (casing body) featuring a semi-circular floor portion, and is capable of accommodating the wireless LAN transmitter/receiver 26 that has been connected to the USB connector 30. At two end portions of a 'U'-shaped side wall 50A of the cover 50, locking pawls 52 are formed which extend toward an opening portion 50B of the cover 50 and serve as a first engaging member and an engaging pawl. Around the opening portion 50B, a flange portion 50C is formed. A plurality of bosses 50D for positioning are formed at this flange portion 50C. Correspondingly, a plurality of positioning holes 14G into which the bosses 50D can be fitted are formed in the outer wall 14A in correspondence with the respective bosses 50D.

When the bosses 50D are inserted into the positioning holes 14G, the locking pawls 52 are inserted into the through-hole 14E and the flange portion 50C abuts against the outer wall 14A. Correspondingly, the locking pawls 52 engage with hole walls of the through-hole 14E. Hence, the cover 50 is anchored at the outer wall 14A. The locking pawls 52 are capable of elastically deforming to inner sides of the through-hole 14E. By elastically deforming the locking pawls 52 and extracting the locking pawls 52 from the through-hole 14E, it is also possible to remove the cover 50 from the outer wall 14A.

Now, in the state in which the frame 14 is mounted at the specified position of the image-forming apparatus main body 12, the locking pawls 52 are disposed at the inner side of the image-forming apparatus main body 12 relative to the outer wall 14A, and thus the locking pawls 52 are inoperable. Therefore, in the state in which the frame 14 is mounted at the specified position of the image-forming apparatus main body 12 and the frame 14 is locked to the image-forming apparatus main body 12 by the locked KENSINGTON LOCK 44, the cover 50 cannot be removed from the frame 14, and the wireless LAN transmitter/receiver 26 cannot be removed from the frame 14. Thus, theft of the wireless LAN transmitter/receiver 26 can be prevented.

Next, a second embodiment of the present invention will be described. Here, structures that are the same as in the first embodiment are assigned the same reference numerals, and descriptions thereof will not be given.

Figure 8:
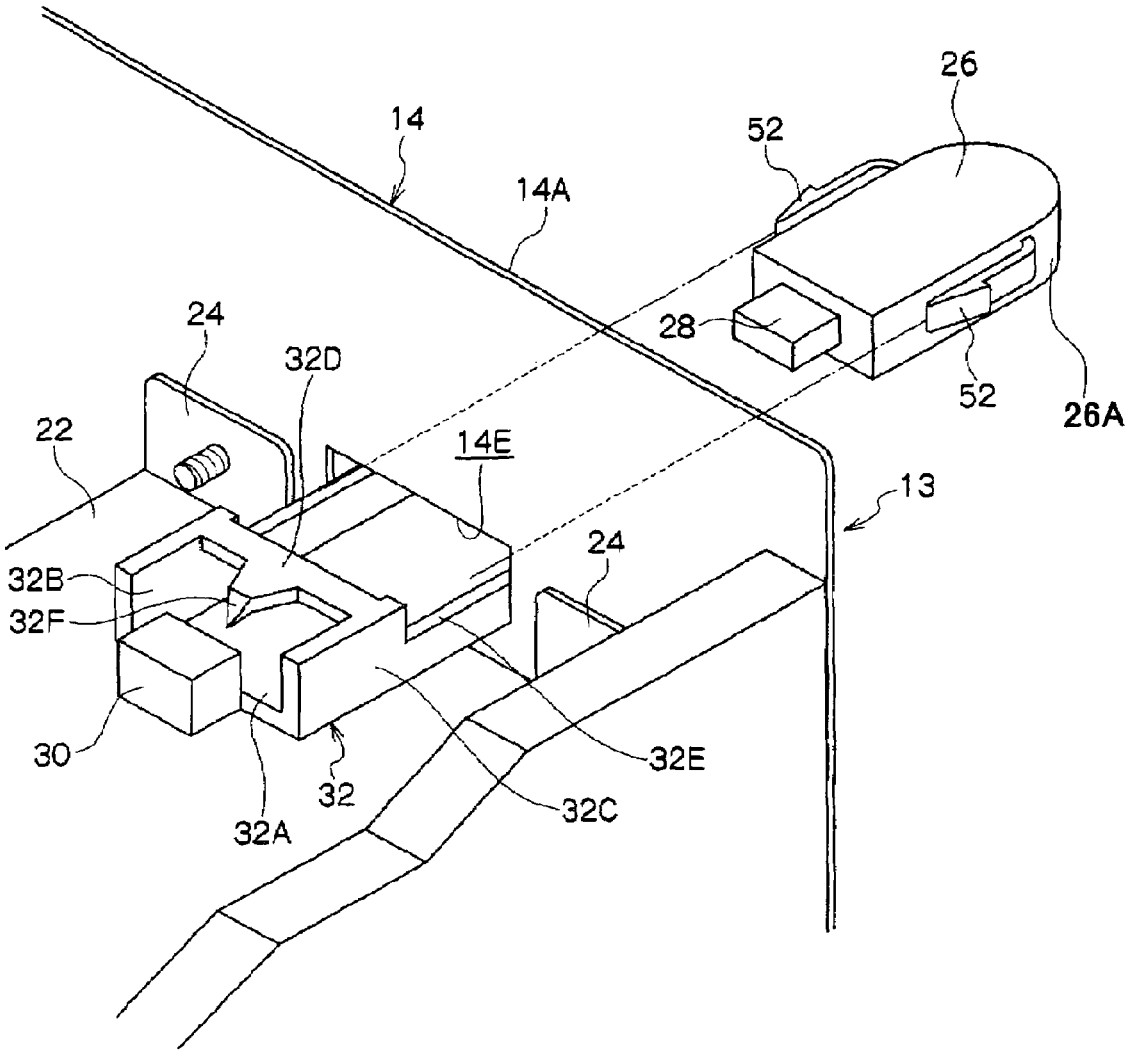
FIG. 8 is a perspective view showing an enlargement of a portion of a unit which is provided at an image-forming apparatus of a second embodiment of the present invention.

As shown in FIG. 8, in the present embodiment, the locking pawls 52, which serve as a second engaging member and an engaging pawl, are formed to extend toward the USB connector 28 side from two end portions of a 'U'-shaped wall face 26A of the wireless LAN transmitter/receiver 26. The locking pawls 52 are inserted into the through-hole 14E, which serves as a second engaged portion and an engaging hole, and the USB connector 28 connects with the USB connector 30. Correspondingly, the locking pawls 52 engage with hole walls of the through-hole 14E. Hence, the wireless LAN transmitter/receiver 26 is anchored at the outer wall 14A. The locking pawls 52 are capable of elastically deforming to the inner sides of the through-hole 14E. Thus, it is also possible to elastically deform the locking pawls 52, extract the locking pawls 52 from the through-hole 14E, and remove the wireless LAN transmitter/receiver 26 from the outer wall 14A.

Here, in the state in which the frame 14 is mounted at the specified position of the image-forming apparatus main body 12, the locking pawls 52 are inoperable. Therefore, in the state in which the frame 14 is mounted at the specified position of the image-forming apparatus main body 12 and the frame 14 is locked to the image-forming apparatus main body 12 by the locked KENSINGTON LOCK 44, the wireless LAN transmitter/receiver 26 cannot be removed from the frame 14. Thus, theft of the wireless LAN transmitter/receiver 26 can be prevented.

Hereabove, the present invention has been described in detail for particular embodiments, but the present invention is not limited to these embodiments and it will be clear to those skilled in the art that various other embodiments are possible within the scope of the present invention. For example, in the present embodiments, the present invention is applied to the image-forming apparatus 10, but the present invention could also be applied to other electronic apparatuses, such as notebook computers and the like.

Moreover, in the present embodiments, the through-hole 14E serving as the first engaged portion and the engaging hole is provided at the unit 13 and the locking pawls 52 serving as the first engaging member and the engaging pawl are provided at the cover 50, which serves as the stopper member and the cover body. However, the first engaged portion/engaging hole could be provided at a stopper member/cover body and the first engaging member/engaging pawl could be provided at a unit.

Furthermore, in the present embodiments, the through-hole 14E serving as the second engaged portion and the engaging hole is provided at the unit 13 and the locking pawls 52 serving as the second engaging member and the engaging pawl are provided at the wireless LAN transmitter/receiver 26, which serves as a mounted component. However, the second engaged portion/engaging hole could be provided at a mounted component and the second engaging member/engaging pawl could be provided at a unit.

Further yet, for the present embodiments, it has been described that the unit 13 is provided with the frame 14 which is structured by the outer wall 14A and the like, to which circuit boards such as the controller circuit board 16, the HDD circuit board 20, the wireless LAN interface circuit board 22 and the like are attached. However, circuit boards, such as the controller circuit board 16, the HDD circuit board 20, the wireless LAN interface circuit board 22 and the like, may be formed separately from the outer wall 14A. In such a case, a stopper member could be provided at a circuit board and could be provided at the outer wall 14A.

The foregoing descriptions of the exemplary embodiments of the present invention have been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electronic apparatus comprising:

a unit which is mountable and removable at an electronic apparatus main body;

a locking component which, in a locked state, impedes removal of the unit from the electronic apparatus main body and, in an unlocked state, allows removal of the unit from the electronic apparatus main body, wherein the locking component is configured to be locked into the lock state and unlock into the unlocked state using a key;

a mounted component which is mounted at the unit to be removable to outside the electronic apparatus main body;

a stopper member which is mounted at the unit and covers the mounted component to impede removal of the mounted component from the unit;

an engaged portion which is provided at one of the unit or the stopper member; and an engaging portion which is provided at the other of the unit or the stopper member, the engaging portion engaging with the engaged portion when the stopper member is mounted at the unit and impeding removal of the stopper member from the unit, the engaging portion is configured to be accessible for releasing the engagement with the engaged portion when the unit is not mounted at the electronic apparatus main body, and the engaging portion is configured to be inaccessible for releasing the engagement when the unit is mounted at the electronic apparatus main body.

2. The electronic apparatus of claim 1, wherein the stopper member includes a cover body which covers the mounted component.

3. The electronic apparatus of claim 1, wherein the engaged portion includes an engaging hole provided at the unit, and the engaging portion includes an engaging pawl provided at the stopper member, the engaging pawl being inserted into the engaging hole and engaging with the engaging hole at an inner side of the electronic apparatus main body.

4. The electronic apparatus of claim 2, wherein the engaged portion includes an engaging hole provided at the unit, and the engaging portion includes an engaging pawl provided at the stopper member, the engaging pawl being inserted into the engaging hole and engaging with the engaging hole at an inner side of the electronic apparatus main body.

5. An electronic apparatus comprising:

a unit which is mountable and removable at an electronic apparatus main body;

a locking component which, in a locked state, impedes removal of the unit from the electronic apparatus main body and, in an unlocked state, allows removal of the unit from the electronic apparatus main body, wherein the locking component is configured to be locked into the lock state and unlock into the unlocked state using a key;

a mounted component which is mounted at the unit to be removable to outside the electronic apparatus main body;

an engaged portion which is provided at one of the unit or the mounted component; and an engaging portion which is provided at the other of the unit or the mounted component, the engaging portion engaging with the engaged portion when the mounted component is mounted at the unit and impeding removal of the mounted component from the unit, the engaging portion is configured to be accessible for releasing the engagement with the engaged portion when the unit is not mounted at the electronic apparatus main body, and the engaging portion is configured to be inaccessible for releasing engagement with the engaged portion when the unit is mounted at the electronic apparatus main body.

6. The electronic apparatus of claim 5, wherein the engaged portion includes an engaging hole provided at the unit, and the engaging portion includes an engaging pawl provided at the mounted component, the engaging pawl being inserted into the engaging hole and engaging with the engaging hole at an inner side of the electronic apparatus main body.

7. The electronic apparatus of claim 1, wherein the mounted component includes a wireless terminal.

8. The electronic apparatus of claim 1, wherein the unit is equipped with a communications interface device.

9. The electronic apparatus of claim 1, wherein the unit includes a mount-receiving portion at which the mounted component is removably mounted; and a guide portion for guiding mounting of the mounted component toward the mount-receiving portion.

10. An electronic apparatus comprising:

a circuit board disposed in an electronic apparatus main body;

an outer wall of the electronic apparatus main body which is mountable and removable at the electronic apparatus main body;

a locking component which, in a locked state, impedes removal of the outer wall from the electronic apparatus main body and, in an unlocked state, allows removal of the outer wall from the electronic apparatus main body, wherein the locking component is configured to be locked into the lock state and unlock into the unlocked state using a key;

a mounted component which is mounted at the circuit board to be removable to outside the electronic apparatus main body;

a stopper member which is mounted at the outer wall and covers the mounted component to impede removal of the mounted component from the circuit board;

an engaged portion which is provided at one of the outer wall or the stopper member; and an engaging portion which is provided at the other of the outer wall or the stopper member, the engaging portion engaging with the engaged portion when the stopper member is mounted at the outer wall and impeding removal of the stopper member from the outer wall, the engaging portion is configured to be accessible for releasing the engagement with the engaged portion when the outer wall is not mounted at the electronic main body, and the engaging portion is configured to be inaccessible for releasing the engagement when the outer wall is mounted at the electronic apparatus main body.

11. The electronic apparatus of claim 10, wherein the circuit board includes a mount-receiving portion at which the mounted component is removably mounted; and a guide portion for guiding mounting of the mounted component toward the mount-receiving portion.

12. An electronic apparatus comprising:

a circuit board disposed in an electronic apparatus main body;

an outer wall of the electronic apparatus main body which is mountable and removable at the electronic apparatus main body;

a locking component which, in a locked state, impedes removal of the outer wall from the electronic apparatus main body and, in an unlocked state, allows removal of the outer wall from the electronic apparatus main body, wherein the locking component is configured to be locked into the lock state and unlock into the unlocked state using a key;

a mounted component which is mounted at the circuit board to be removable to outside the electronic apparatus main body;

an engaged portion which is provided at one of the outer wall or the mounted component; and an engaging portion which is provided at the other of the outer wall or the mounted component, the engaging portion engaging with the engaged portion when the mounted component is mounted at the circuit board and impeding removal of the mounted component from the outer wall, the engaging portion is configured to be accessible for releasing the engagement with the engaged portion when the outer wall is not mounted at the electronic apparatus main body, and the engaging portion is configured to be inaccessible for releasing the engagement with the engaged portion when the outer wall is mounted at the electronic apparatus main body.

13. The electronic apparatus of claim 12, wherein the circuit board includes a mount-receiving portion at which the mounted component is removably mounted; and a guide portion for guiding mounting of the mounted component toward the mount-receiving portion.

14. An electronic apparatus comprising:

a circuit board disposed in an electronic apparatus main body;

an outer wall of the electronic apparatus main body, the outer wall being mountable and removable at the electronic apparatus main body;

a locking component which, in a locked state, impedes removal of the outer wall from the electronic apparatus main body and, in an unlocked state, allows removal of the outer wall from the electronic apparatus main body, wherein the locking component is configured to be locked into the lock state and unlock into the unlocked state using a key;

a mounted component which is mounted at the circuit board to be removable to outside the electronic apparatus main body;

a stopper member which is mounted at the circuit board and covers the mounted component to impede removal of the mounted component from the circuit board;

an engaged portion which is provided at one of the circuit board or the stopper member; and an engaging portion which is provided at the other of the circuit board or the stopper member, the engaging portion engaging with the engaged portion when the stopper member is mounted at the circuit board and impeding removal of the stopper member from the circuit board, the engaging portion is configured to be accessible for releasing the engagement with the engaged portion when the outer wall is not mounted at the electronic apparatus main body, and the engaging portion is configured to be inaccessible for releasing the engagement with the engaged portion when the outer wall is mounted at the electronic apparatus main body.

15. The electronic apparatus of claim 14, wherein the circuit board includes a mount-receiving portion at which the mounted component is removably mounted; and a guide portion for guiding mounting of the mounted component toward the mount-receiving portion.

16. An electronic apparatus comprising:

a circuit board disposed in an electronic apparatus main body;

an outer wall of the electronic apparatus main body, the outer wall being mountable and removable at the electronic apparatus main body;

a locking component which, in a locked state, impedes removal of the outer wall from the electronic apparatus main body and, in an unlocked state, allows removal of the outer wall from the electronic apparatus main body, wherein the locking component is configured to be locked into the lock state and unlock into the unlocked state using a key;

a mounted component which is mounted at the circuit board to be removable to outside the electronic apparatus main body;

an engaged portion which is provided at one of the circuit board or the mounted component; and an engaging portion which is provided at the other of the circuit board or the mounted component, the engaging portion engaging with the engaged portion when the mounted component is mounted at the circuit board and impeding removal of the mounted component from the circuit board, the engaging portion is configured to be accessible for releasing the engagement with the engaged portion when the outer wall is not mounted at the electronic apparatus main body, and the engaging portion is configured to be inaccessible for releasing the engagement when the outer wall is mounted at the electronic apparatus main body.

17. The electronic apparatus of claim 16, wherein the circuit board includes a mount-receiving portion at which the mounted component is removably mounted; and a guide portion for guiding mounting of the mounted component toward the mount-receiving portion.

* * * * *